United States Patent [19]

Shields

[11] 4,065,498

[45] Dec. 27, 1977

[54] MULTIPLE METAL DEACTIVATORS, METHOD FOR PREPARING, AND USE THEREOF

[75] Inventor: Theodore C. Shields, Ashland, Ky.

[73] Assignee: Ashland Oil, Inc., Ashland, Ky.

[21] Appl. No.: 758,642

[22] Filed: Jan. 12, 1977

Related U.S. Application Data

[62] Division of Ser. No. 557,001, March 10, 1975, Pat. No. 4,022,835.

[51] Int. Cl.[2] ..... C07C 119/00

[52] U.S. Cl. ..... 260/566 F

[58] Field of Search ..... 260/566 F

[56] References Cited

U.S. PATENT DOCUMENTS 2,285,878 6/1942 White et al. ..... 252/51

*Primary Examiner*—Gerald A. Schwartz

*Attorney, Agent, or Firm*—Van D. Harrison, Jr.

[57] ABSTRACT

Disclosed is a reaction product and method for making same for use in suppressing the ability of solubilized copper, iron, cobalt, nickel, chromium and manganese present in hydrocarbon liquids, such as gasoline and fuel oil, to catalyze oxidative degradation. The reaction product is obtained by reacting 1,2-alkane diamine, a 2,4-dione and an ortho-hydroxy aromatic aldehyde, in stoichiometric proportions, preferably in an inert liquid medium. A preferred reaction product is that obtained by reacting ethylenediamine, 2,4-pentanedione and salicylaldehyde in a 1 to 1 to 1 mole ratio.

12 Claims, No Drawings

MULTIPLE METAL DEACTIVATORS, METHOD FOR PREPARING, AND USE THEREOF

This application is a division of copending application Ser. No. 557,001, filed Mar. 10, 1975, now Pat. No. 4,022,835.

BACKGROUND OF THE INVENTION

1. Field of the Invention

This invention relates to novel metal deactivators. More specifically, it relates to reaction or condensation products of aliphatic polyamines, beta-diketones and salicylaldehyde or substituted salicylaldehydes, the method of preparing these condensation products, and their use as metal deactivators in hydrocarbon fuels.

2. Description of the Prior Art

In the storage of gasoline, middle distillates, and other liquid hydrocarbon fuels, one of the greatest problems is the formation of gums, tars and undesirable colored impurities brought about by the degradation of these fuels when they are permitted contact with atmospheric oxygen. Oxidative degradation is catalyzed strongly by solubilized copper but also to a significant extent by solublized iron, cobalt, nickel, chromium and manganese present in the fuels. These metals are introduced into the fuels in the course of refining, storing and shipping.

One solution to this problem of oxidative degradation has been to add to fuels compounds which deactivate the solubilized metals, particularly copper, thereby suppressing their catalytic capacity and substantially reducing oxidative degradation.

Compounds which have been particularly utilized as metal deactivators are the condensation products of amines, particularly polyamines with aldehydes and ketones. U.S. Pat. Nos. 2,055,810; 2,181,121; 2,255,597; 2,264,894; 2,282,513; 2,301,861; 2,426,206; 2,461,894; and 2,533,205, disclose compounds of this nature for suppressing the activity of solubilized metals, particularly copper, in the oxidative degradation of hydrocarbon fuels.

Of the foregoing, the compounds disclosed in U.S. Pat. No. 2,181,121 have been the ones most widely used in industry. These compounds are obtained by condensing one mole of a polyamine containing at least two primary amine groups with at least two moles of an ortho-hydroxy substituted aldehyde which is aromatic in nature. Commercially, the compound most widely used has been the reaction product of salicylaldehyde and 1,2-propanediamine which has the following structure:

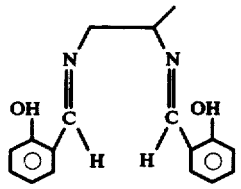

and is known ordinarily as N,N'-disalicylidene-1,2-propanediamine or as 1,2-disalicylidenepropanediamine.

However, as pointed out in U.S. Pat. No. 2,462,668, N,N'-disalicylidene-1,2-propanediamine, while effective to deactivate copper, can be ineffective to deactivate chromium or nickel, and can actually promote the oxidant effects of manganese, iron and cobalt. A metal deactivator which will function to deactivate a greater range of metal contamination in hydrocarbon fuels is thus highly desirable.

As noted previously, one of the reactants utilized to make N,N'-disalicylidene-1,2-propanediamine is 1,2-propanediamine. The supply of 1,2-propanediamine appears currently to be diminishing so that it becomes necessary to turn to other more inexpensive and available polyamines. An obvious choice would appear to be the condensation product of the more plentiful ethylenediamine and salicylaldehyde, N,N'-disalicylidene-1,2-ethanediamine having the following structure:

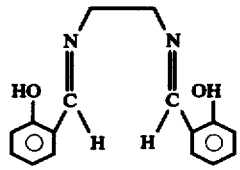

N,N'-disalicylidene-1,2-ethanediamine

Unfortunately, the condensation product of ethylenediamine with salicylaldehyde in comparison to N,N'-disalicylidene-1,2-propanediamine is markedly less soluble in hydrocarbons, both itself and when it is complexed with copper and is functioning as a deactivator. This is demonstrated in the following data from page 84 of *Technical Notes* 1963–64, Petroleum Chemicals Division, E. I. DuPont de Nemours & Co. (Inc.). The ethylenediamine salicylaldehyde condensation product is thus less effective as a copper deactivator. If one attempts to increase solubility by using homologous compounds of increased chain length, for example 1,6-diaminohexane, efficiency as a metal deactivator is substantially reduced.

Solubility of Deactivators and Their Chelates in Jet Fuels

| Jet Fuel | Salicylaldehyde: 1,2-Propanediamine | Salicylaldehyde: Ethylenediamine | Type of Copper Chelate: 1,2-Propanediamine | Type of Copper Chelate: Ethylenediamine |
|---|---|---|---|---|
| A | 370 | 142 | 1.0 | 0.04 |
| B | 930 | 107 | — | — |
| C | — | — | 0.5 | 0.1 |
| D | — | — | 6.5 | 0.04 |
| E | — | — | 0.6 | <0.04 |
| F | — | — | 1.0 | 0.04 |

Accordingly, one object of this invention is to retard the oxidative degradation of hydrocarbon fuels and other liquid hydrocarbon mixtures. Another object of this invention is to provide a metal deactivating composition which will suppress not only the ability of solubilized copper to catalyze oxidative degradation in hydrocarbon fuels, but that of other trace metals such as manganese, iron, cobalt, nickel and chromium. Still another object of this invention is to make available a soluble metal-deactivating composition formulated, at least in part, from readily available and inexpensive ethylenediamine. Yet another object of this invention it to provide a method for making a metal deactivating composition having the foregoing desirable characteristics.

SUMMARY OF THE INVENTION

Briefly stated, in one aspect, this invention comprises adding to a hydrocarbon liquid, subject to oxidative degradation in the presence of manganese, copper, iron, cobalt, nickel and chromium, and their compounds, the reaction product obtained by condensing one mole of an aliphatic polyamine containing at least two primary amino groups with approximately one mole of an ortho-hydroxy substituted aromatic aldehyde and approximately one mole of an aliphatic beta-diketone. In another aspect this invention comprises the method of making this reaction product, and, in a third aspect, the invention comprises the reaction product by process itself.

The polyamine can be any aliphatic polyamine containing at least two primary amino groups directly attached to different aliphatic carbon atoms of the same open chain. The preferred polyamines are the alkane diamines in which the primary amino groups bear a 1,2- or 1,3-relationship such as ethylenediamine, 1,2-propanediamine, 1,3-propanediamine, 1,2-diaminocyclohexane, 2,3-diaminobutane, 1,3-butanediamine and 2,4-pentanediamine. Ethylenediamine is a particularly preferred amine. Other, less preferred, amines are 1,6-hexanediamine and diethylenetriamine, and mixtures of 1,2- or 1,3-diamines.

The ortho-hydroxy aromatic aldehyde has the structural formula:

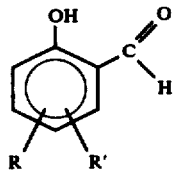

where R and R' are hydrogen or aliphatic radicals having a total of 0 to 12 carbon atoms.

The preferred aromatic aldehyde is salicylaldehye where R and R' are both hydrogen.

The aliphatic beta-diketone has the general formula:

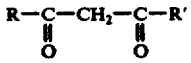

wherein R or R' is an aliphatic group having between one and six carbon atoms. Examples are 2,4-pentanedione; 2,2,6,6-tetramethyl-3,5-heptanedione; 2,6-dimethyl-3,5-heptanedione; 3,5-heptanedione, 2,4-hexanedione; 5-methyl-2,4-hexanedione, 5,5-dimethyl-2,4-hexanedione and 2-phenyl-3,5-heptanedione. The preferred compound is 2,4-pentanedione.

The remainder of this specification describes the reaction products derived from permitting pure or mixed polyamines to react with 2,4-pentanedione, and salicylaldehyde. It is to be understood that the aforedescribed condensation products, when made with ethylenediamine can be formulated not only from pure ethylenediamine but also from polyamine mixtures containing ethylenediamine.

The preferred method of making the condensation product of this invention is to first permit 2,4-pentanedione to react with ethylenediamine in the ratio of between about 0.6 and about 1.4 moles of 2,4-pentanedione per mole of ethylenediamine. Preferably, this ratio of 2,4-pentanedione to ethylenediamine is between 1.1 and 1 moles respectively. Although not absolutely required, preferably the reaction is conducted in an inert organic solvent such as tetrahydrofuran, ethanol, isopropanol, diethylether, xylene, methanol, benzene, or preferably, toluene. The temperature of the reaction between the ethylenediamine and 2,4-pentanedione is best maintained between about 70° C. to 90° C., to avoid the formation of white solids at low temperature (approximately 30° C.) and gums at high temperature (approximately 200° C.). At higher temperatures, a less pure product will result. When reaction between the ethylenediamine and the 2,4-pentanedione is completed, as indicated by the cessation of the heat of reaction, the reaction mixture is cooled to a temperature below about 60° C. or, preferably, below 40° C. and an approximately stoichiometric amount (between 0.6 and 1.4, or preferably 0.9 to 1.0 moles) of salicylaldehyde is added per mole of ethylenediamine. The temperature at which the salicylaldehyde is added may be higher (up to 200° C.) when added in a continuous reactor system which permits less residence time than batch preparation. A total of about 2 moles of salicylaldehyde and 2,4-pentanedione together is thus permitted to react with one mole of ethylenediamine. It is desirable to maintain the temperature of the second reaction below 40° C. to avoid the formation of undesirable tars and gums. All reactions are conducted preferably at atmospheric pressure. At the conclusion of the second reaction, especially when it is carried out in sufficient solvent, (such as toluene) so as to result in an approximately 50 percent by weight solution, the desired reaction product (the ethylenediamine-2,4-pentanedione-salicylaldehyde condensation product) separates into an organic liquid phase and a water phase. The reaction product can be used as a metal deactivator, with or without drying, after being decanted. If sufficient organic solvent reaction medium, such as toluene has been used, the reaction products will remain dissolved in the medium and can be added in this form to the hydrocarbon fuel to be treated.

The foregoing ratios of reactants are based on the assumption that the ethylenediamine is relatively pure. If mixed amines are used, the permissible ranges of carbonyl reactants (beta-diketones, salicylaldehyde substituted salicylaldehyde, etc.) may be broadened. As mentioned previously, the range limit of pentanedione is 30 to 70% (0.6 to 1.4 mole) of equivalency to one mole of ethylenediamine; therefore the range limit for salicylaldehyde is 70 to 30 percent of equivalency. Exceeding these ranges results in product mixtures of unacceptable solubility. The purpose of permitting mixed reaction of 2,4-pentanedione and salicylaldehyde with a diamine such as ethylenediamine is fourfold:

1. To make a product mixture which, on the average has poorer symmetry than that derived from either 2,4-pentanedione only, or salicylaldehyde only. This results in much better solubility in organic solvents
2. To prepare a product which is more inexpensive than that derived from pure salicylaldehyde
3. To prepare a product which has better deactivation properties than that derived from pure 2,4-pentanedione.
4. To prepare a product which will possess, on the average, a larger chelation ring than does N,N'-disalicylidene-1,2-propanediamine. This permits it to deactivate other metals besides copper.

Besides mixing two carboxyl reactants with the same amine, increased solubility in organic solvents can be obtained by using multiple amine precursors A particularly preferred reaction product is that obtained when the mole ratio of beta diketone to 1,2-polyamine is between about 1.4 to 1 and about 0.6 to 1, the number of moles of ortho-hydroxybenzaldehyde reacted is equal to twice the number of moles of 1,2-polyamines less the number of moles of beta-diketone reacted, the ratio of the total moles of beta-diketone and ortho-hydroxybenzaldehyde reacted to the total moles of 1,2- and 1,3-polyamines is about 2 to 1, and the mole ratio of 1,3-polyamines to 1,2-polyamines is between about 5 to 1 and about 0 to 1.

EXAMPLE 1

To 300 ml (approximately 261 grams) of toluene was added 60 grams (1 gram mole) of ethylenediamine. The solution was heated to 70° C. To this solution, 100 grams (1 gram mole) of 2,4-pentanedione was slowly added with continuous stirring. Heat was evolved during this step and the temperature was allowed to reach a maximum of 80° C. When the reaction was complete, the mixture was cooled to a temperature of 33° C. and 122 grams (1 gram mole) of salicylaldehyde was slowly added. The rection temperature was maintained below about 40° C. When all of the salicylaldehyde had been added, the reaction mixture was allowed to stand overnight at room temperature. The solution of metal deactivator in toluene separated into a clear yellow-brown phase above a layer of water.

EXAMPLE 2

This example illustrates the need to minimize and control the temperature at which the salicylaldehyde is added and permitted to react to a maximum of about 60° C. and preferably a maximum of 40° C. or below. In 110 ml of toluene, 24 grams (0.4 gram moles) of ethylenediamine were permitted to react with 40 grams (0.4 gram moles) of 2,4-pentanedione as in Example 1. The maximum reaction temperature at this point was 75° C. To this mixture 48.8 grams (0.4 gram moles) of salicylaldehyde were added. The temperature rose to 80° C. Although a usable product was obtained, it contained highly colored gummy toluene-insoluble material.

EXAMPLE 3

In 141 ml of toluene, 30 grams (0.5) moles of ethylenediamine were permitted to react with 52 grams (0.52 moles) of 2,4-pentanedione. The maximum temperature reached was about 66° C. The reaction mixture was then cooled to a temperature of 20° C. and 58.6 grams of salicylaldehyde was added over a period of twenty minutes. The desired reaction product separated into a clear phase which was decanted and dried as in Example 1. There was no evidence of gummy toluene insolubles. At the end of three days, there was still no indication of solids. This product which was about a 50 percent by weight toluene solution, would precipitate solids from solutions if stored for extended periods at temperatures below about 10° C. Its utility in such concentration is therefore limited.

The use of mixed amine precursors can result in a far more acceptable product, with respect to storage temperature performance.

The following examples illustrate the preparation of a mixed amine condensation product. Example 4 illustrates the preparation of the product resulting from the reaction of ethylenediamine with 2,4-pentanedione and salicylaldehyde and 1,3-propanediamine with salicylaldehyde in such a way that a 50—50 mole ratio of the two amine-derived products results. Example 5 illustrates the condensation of ethylenediamine, 1,6-diaminohexane, and 1,2-diaminocyclohexane with 2,4-pentanedione and salicylaldehyde.

EXAMPLE 4

Six grams (0.1 moles) of ethylenediamine were mixed with 52 grams of toluene in a glass reactor. Ten grams (0.1 moles) of 2,4-pentanedione were then added slowly over a ten-minute period with heating. The temperature increased from 60° C. to 80° C. over this period of time. The reaction mixture was then cooled to 25° C. over a five-minute interval. Next, 7.4 grams (0.1 moles) of 1,3-propanediamine were added after a five-minute interval. Thirty-six grams (0.3 moles) of salicylaldehyde was next added to the reaction mixture over a fifteen minute period, during which time the mixture was continually cooled to maintain the reaction temperature 40° C. The reaction mixture was subsequently stirred while the temperature was maintained between 25° C. and 20° C. The reaction mixture was then poured into a separatory funnel and allowed to separate into two immiscible layers, a bottom layer of water and a top layer of the desired metal deactivator product. The water layer (7.6 grams, 0.42 moles) was drawn off and discarded. The metal deactivator product amounting to 103.3 grams (including solvent), was dried by passing it through several layers of filter paper. This product is believed to constitute a 50% by weight toluene solution of a product which was a mixture of products, having these structural formulas:

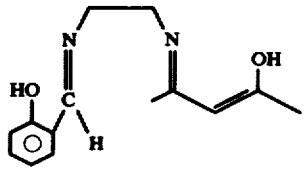

N-(4-hydroxyl-2-pent-3-enylidene)-N'-salicylidene-1,2-ethanediamine (average structure)

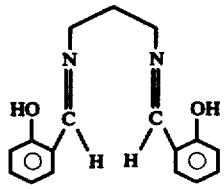

1,3-disalicylidene propanediamine

EXAMPLE 5

Twelve grams (0.2) moles of ethylenediamine and 24 grams (0.2 moles) of a 50—50 mole percent mixture of 1,6-diaminohexane and 1,2-diaminocyclohexane were mixed with 113 grams of toluene in a glass reactor. Forty grams (0.4 moles) of 2,4-pentanedione were then added slowly over a ten-minute period as the temperature was raised from 50° C. to 80° C. The clear, pale yellow liquid was stirred for an additional period of 15 minutes while the temperature was maintained at 75° -80° C. The reaction mixture was then cooled to 25° C. Next, 49 grams (0.4 moles) of salicylaldehyde was added over a 15-minute period while the reaction mixture was continually cooled to maintain the temperature below 40° C. After another 60-minute of stirring, at a temperature of between 25° C. and 20° C., the reaction mixture was removed to a separatory funnel where over a period of 60 minutes, it separated into a 2-phase mixture; a bottom layer of water and a top layer of product. The water layer, 15.1 grams, was discarded and 225.4 grams of the dried desired solution of metal deactivator was obtained. The product obtained is thought to constitute, theoretically, a 50 percent, by weight, toluene solution of mixed reaction products.

EXAMPLE 6

The desirability of followng the steps of the reaction procedure as outlined specifically in Example 4 was demonstrated when the reactants used in this example were combined in a different sequence of steps. In two attempts to produce the reaction product of Example 4, the ultimate reaction product contained large quantities of solid crystalline material which hampered handling the product and made drying the product all but impossible. The following run is typical for the reactants used in Example 4.

One-tenth of a gram mole 1,3-propanediamine in 52 grams of toluene was permitted to react with salicylaldehyde in a mole ratio of 0.1 gram mole of 1,3-propanediamine to 0.2 gram moles of salicylaldehyde at a temperature of 40° C. At this point in the reaction a two-phase mixture resulted. One-tenth (0.1) of a gram mole of ethylenediamine was then added and followed by 0.1 gram mole of 2,4-pentanedione. During the addition of the pentanedione, the temperature varied from 40° C. to 80° C. The reaction mixture was then cooled to a temperature of 25° C. and 12.0 grams (0.1 gram moles) of salicylaldehyde was added. The total amount of salicylaldehyde added was 0.3 gram moles. Upon being allowed to stand, the reaction mixture separated into an aqueous layer and a layer of reaction product. Separation was, however, hampered by the large quantity of solid crystalline material separating out, even at room temperature, so that no filtration drying was possible.

The ethylenediaine-2,4-pentanedione-salicylaldehyde condensation product of this invention is not soluble in organic solvents at all concentrations. It has been suggested previously that the condensation reaction can be conducted in an organic solvent, such as toluene, which later functions as a solvent or carrier liquid for the resultant condensation product. For example, if the concentration of condensation product in the solvent is 50 percent by weight and the temperature falls below 10° - 15° C., some precipitation of condensation product may occur. Such precipitated solids can be dissolved either by diluting with additional solvent or by raising the temperature and agitating. There is, of course, no problem of solubility of the condensation product in the gasoline, desired fuel, or other liquid hydrocarbon to which it may be added.

Where the condensation product is a mixed condensation product of ethylenediamine and another diamine such as the 1,3-propanediamine of Example 4 or the 1,6-diaminohexane and 1,2-diaminocyclohexane of Example 5, then the condensation product is more significantly soluble in the carrier solution than the unmodified ethylenediamine condensation product. This is demonstrated by tests from which the data tabulated below was obtained. The tests were conducted by submitting a 50 percent solution in toluene of the condensation products obtained in Examples 4 and 5, as well as a 50 percent solution of product like that obtained in Example 1, to temperatures of 0° C. - 18° C., and 40° C. The time taken for solid material to precipitate out, or for the solution to solidify completely, was noted. In the following table the phrase "indefinite" means there was no solidification or precipitation when the sample was chilled at least overnight.

| Condensation Product of | 0° C. | −18° C. | −40° C. |
|---|---|---|---|
| Example 4 | Indefinite | 6 hours | 2 hours |
| Example 5 | Indefinite | 4 hours | 1 hour |
| Example 1 | Overnight | 1 hour | 15 minutes |

EXAMPLE 7

Under the same conditions of temperature and procedure as set forth in Example 1, 0.2 gram moles of 1,2-propanediamine dissolved in toluene were allowed to first react with 0.1 gram moles of 2,4-pentanedione and, subsequently, with 0.3 gram moles of salicylaldehyde. The resulting organic solution obtained was calculated stoichiometrically to be a 50 percent solution by weight of mixed reaction products in toluene having the structures:

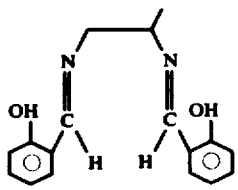

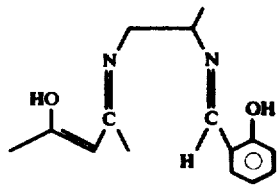

(average structure)

EXAMPLE 8

A toluene solution of 0.2 gram moles of 1,2-propanediamine was allowed to react with 0.4 gram moles of 2,4-pentanedione under the conditions used in Example 1 to react ethylenediamine and 2,4-pentanedione. No salicylaldehyde was reacted. The resulting organic liquid solution obtained was calculated to be a 50 percent solution in toluene of a reaction product having the structure:

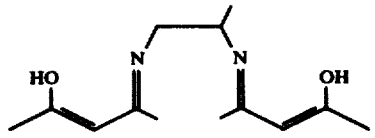

N,N'-di(4-hydroxy-2-pent-3-enylidene)-1,2-propanediamine

EXAMPLE 9

A toluene solution of 0.2 gram moles of 1,3-propanediamine was permitted to react with 0.4 gram moles of salicylaldehyde at a temperature of between 33° and 40° C. No 2,4-pentanedione was added. A 50 percent solution of reaction product was obtained having the structure:

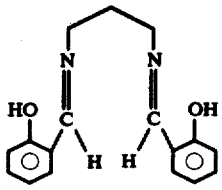

GASOLINE AND FUEL TESTING

The Environmental Protection Agency has published survey data showing that the solubilized metals which occur most commonly in conventional gasoline in sufficient quantities to catalyze oxidative degradation are:

| | Average concentration, microgram per gram of gasoline |
|---|---|
| Copper | 0.11 |
| Cobalt | 0.005* |
| Iron | 2.87 |
| Nickel | 0.072 |
| Manganese | .01 |
| Chromium | .03 (estimated) |

Source: American Chemical Society, 166th National Meeting, Fuel Paper No. 33 (1973)

*Private communication - not published by EPA

In the description of tests and presentation of data which follows the test method used was the standard test for oxidation stability of gasoline (induction period method) ASTM test D 525-74. The induction period obtained in this test is a measure of the tendency of the gasoline to form gum (to oxidatively degrade) while in storage. The test in brief is based on exposing a sample of gasoline to oxygen at 100 psi at a temperature between 98 and 102° C. A break-point in the time-pressure curve is determined and the time to reach this point is observed. This measure "induction period" can then be converted by calculation to an induction period at 100° C. The longer the induction period, the greater is the resistance of the gasoline to oxidative degradation.

EXAMPLE 10

Samples of a cracked gasoline fraction containing 5.8 ppm of a commercial additive, UOP-5, trade name for a gasoline additive manufactured by Universal Oil Products, Inc., Des Plains, Illinois, and "poisoned" with 0.162 ppm each of copper, iron and nickel, and 0.014 ppm of cobalt, were treated with samples of reacted products corresponding to Examples 1, 3, 7, 8, and 9 as well as a sample of the prior art metal deactivator, N,N'-disalicylidene-1,2-propanediamine. The concentration of reaction product, exclusive of carrier solvent in each gasoline sample tested was 5.8 ppm. The oxidative stability of each sample was then measured, using ASTM test D 525-74. Test results are tabulated in Table 1. An initial pressure loss occurring before 3.0 hours was considered a failure, and a pressure loss after that period a pass.

TABLE 1

| Additive From Example | Reactions & Mole Ratios | Induction Period, Hours |
|---|---|---|
| N,N'-disalicylidene-1,2-propanediamine | 1,2-propanediamine and salicylaldehyde 1:2 | 2.3 |
| 1 or 3 | ethylenediamine, 2,4-pentadendione and salicylaldehyde, 1:1:1 | 8.5 |
| 7 | 1,2-propanediamine 2,4-pentanedione, and salicylaldehyde 2:1:3 | 4.8 |
| 8 | 1,2-propanediaine, and 2,4-pentanedione 1:2 | 7.8 |
| a | | |
| 9 | 1,3-propanediamine, and salicylaldehyde 1:2 | 10.8 |

From the foregoing table, it is readily apparent that the reaction products from Examples 1 and 7 provide greatly improved oxidation stability over the presently used 1,2-disalicylidene propanediamine.

EXAMPLE 11

In another test, samples of metal deactivator made in a manner similar to that of Examples 1, 7, and 8 were compared with a sample of the prior art metal deactivator, 1,2-disalicylidene propanediamine, in cracked gasoline samples, each "poisoned" with a single metal ion from the group of copper, iron, manganese cobalt, chromium and vanadium. Each gasoline portion tested was poisoned with 0.5 ppm of metal and was treated with 5.8 ppm of additive (excluding carrier solvent). In all instances, all portions tested including the controls contained 5.8 ppm of UOP-5 additive. The induction period for each sample was determined, using the standard ASTM test D 525-74. Results are shown in Table 2 as follows:

TABLE 2

| Additive From Example | Reactants and Mole Ratio | Induction Period, Hours | | | | | |
|---|---|---|---|---|---|---|---|
| | | Copper | Iron | Manganese | Cobalt | Chromium | Vanadium |
| Control | No Metal Deactivator Added | 0.8 | 6.0* | 11.0* | 0.8 | 13.0* | 15.0* |
| N,N'-disalicylidene 1,2-propanediamine | 1,2-propanediamine and salicylaldehyde 1:2 | 15.0 | 5.5 | 10.8 | 0.7 | 12.8 | 14.8 |
| 1 or 3 | ethylenediamine 2,4-pentanedione and salicylaldehyde 1:1:1 | 8.3 | 5.8 | 13.0 | 4.5 | 17.3 | 14.0 |
| 7 | 1,2-propanediamine, 2,4-pentanedione and salicylaldehyde 2:1:3 | 14.5 | 6.8 | | 2.8 | | |
| 8 | 1,2-propanediamine and 2,4-pentanedione 1:2 | 5.5 | | | | | |

*Estimated

From Table 2, it is readily apparent that the metal deactivator corresponding to Examples 1 and 7 is substantially effective, as is the 1,2-disalicylidene propanediamine in deactivating copper and iron but is superior in deactivating manganese, cobalt and chromium.

EXAMPLE 12

To further demonstrate the improved metal deactivation obtained through use of the reaction products of this invention, samples of cracked gasoline from three refineries were obtained. Each gasoline was divided into aliquot portions and each portion was poisoned with 0.375 ppm of solubilized copper, iron, or nickel or 0.01 ppm of cobalt. Metal deactivator was then added to the gasoline in a concentration of 5.8 or 2.9 ppm exclusive of carrier solvent. All samples contained in addition 5.8 ppm of UOP-5 product except those indicated in Table 3 by an asterisk, which contained 14.5 ppm of UOP-5. The oxidation stability (ASTM test D 525-74) of each portion was then measured. The induction period data obtained was then analyzed by the method of Latin Squares. Results of this analysis are tabulated in Table 3.

Table 3 particularly shows the deleterious effect that nickel, and, to a lesser degree, iron and cobalt have on the oxidative stability of a gasoline. The reaction products of this invention compare favorably with 1,2-disalicylidene propanediamine in deactivating copper, and generally, are better in deactivating iron, nickel and cobalt.

TABLE 3

| Sample Corresponding to Example | Reactants, and Mole Ratio | Induction Period, Hours: Treating Level, ppm | Copper .375 ppm | Iron .375 ppm | Nickel .375 ppm | Cobalt 0.01 ppm |
|---|---|---|---|---|---|---|
| Commercial 1,2-disalicylidene propanediamine | | 5.8 | 15.5 | 2.7 | 0.5 | 2.8 |
| Laboratory Prepared 1,2-disalicylidene propanediamine | | 5.8 | 49.5* | 6.0 | 0.5 | 1.0 |
| 1 or 3 | | 2.9 | 13.0 | 3.0 | 0.7* | 4.2 |
| | ethylenediamine, 2,4-pentanedione, and salicylaldehyde 1:1:1 | 5.8 | 15.5 | 3.0 | 6.0 | 11.0* |
| 7 | 1,2-propanediamine | 5.8 | 7.0 | 5.3* | 1.0 | 3.0 |
| | 2,4-pentanedione, and salicylaldehyde 2:1:3 | 2.9 | 4.0* | 4.0* | 1.0 | 3.0 |
| 9 | 1,3-propanediamine, and salicylaldehyde 1:2 | 5.8 | 17.2 | 5.0* | 7.0 | 12.5 |

*Contained 14.5 ppm of UOP additive
Those numbers underlined indicate failure.

EXAMPLE 13

Samples of raw gasoline from refineries were tested for oxidation stability when treated with the prior art metal deactivator, 1,2-disalicylidene propanediamine, and one of the reaction products of this invention, the product of reacting ethylenediamine, 2,4-pentanedione, and salicylaldehyde. All samples tested contained UOP-5 antioxidant compound in a ratio of 5.8 ppm except the sample designated "blank". The sample designated "control" contained the antioxidant UOP-5 but no metal deactivator. The induction period for each sample was determined by the ASTM test used in the other examples. The other gasoline samples containing metal deactivator were not poisoned by adding copper, iron, nickel or cobalt. Any solubilized metals present in the gasoline were there originally, or as a result of the refining process. The concentration of metal deactivator (exclusive of carrier solvent) was 5.8 ppm in gasoline. Results are reported in Table 4.

TABLE 4

| Reaction Product Corresponding to Example | Reactants, Mole Ratios | Induction Period, Hours: Refinery A | Refinery B | Refinery C |
|---|---|---|---|---|
| Blank | | 1.3 | 4.3 | 10.0 |
| Control | | 3.0 | 7.0 | 12.3 |
| 1,2-disalicylidene propanediamine | | 3.5 | 7.25 | 14.3 |
| 1 or 3 | ethylenediamine, 2,4-pentanedione and salicylaldehyde 1:1:1 | 3.8 | 8.8 | 15.5 |
| 9 | 1,3-propanediamine, and salicylaldehyde 1:2 | 4.0 | 9.0 | 16.5 |

EXAMPLE 14

In a procedure almost identical to Example 15, samples of finished blend gasoline were tested from four refineries. These samples corresponded to commercial gasolines containing antioxidants, detergents and metal deactivators. The metal deactivators tested were the same as those of Example 13 and were present in the gasoline samples in a concentration of 5.8 ppm in gasoline. Results are shown in Table 5.

TABLE 5

| Reaction Product Corresponding to Example | Reactants, Mole Ratios | Induction Period, Hours Refinery A | Refinery B | Refinery C | Refinery D |
|---|---|---|---|---|---|
| Blank | | 1.3 | 4.3 | 10.0 | 15.0 |
| Control | | 2.5 | 4.8 | 11.3 | 18.8 |
| 1,2-disalicylidene propanediamine | | 2.9 | 5.0 | 11.5 | 20.0 |
| 1 or 3 | ethylenediamine, 2,4-pentanedione and salicylaldehyde 1:1:1 | 3.2 | 5.5 | 12.0 | 20.8 |
| 9 | 1,3-propanediamine, and salicylaldehyde 1:2 | 2.9 | 5.3 | 11.6 | 20.8 |

From the data derived in Examples 13 and 14, is readily apparent that the reaction product of ethylenediamine, 2,4-propanedione and salicylaldehyde is more effective as a metal deactivator than the prior art deactivator, 1,2-disalicylidene propanediamine.

EXAMPLE 15

The ability of the reaction product of this invention to retard the formation of copper mercaptide gels was demonstrated using the procedure described in Technical Memorandum No. 287, Sept. 1, 1955, published by the Petroleum Chemicals Division of E. I. du Pont, de Nemours & Company, Inc., Wilmington, Delaware. Samples refined from sour Texas — Illinois, Louisiana, sour Arabian and a blend were tested. Each test was conducted by first mixing with one portion of the sample, a measured amount of dodecyl mercaptan and with a separate portion, a measured amount of solubilized copper (copper oleate) and a measured amount of metal deactivator. The two portions were then combined. The formation of the undesirable copper mercaptide gel can be followed visually by the color change associated with the conversion of cupric copper to cuprous mercaptide, the evolution of heat, and the formation of a gel.

Although a test of this nature is highly qualitative, tests with a concentration of 0.2 weight percent of copper in the fuel oil and about 1 percent by weight of metal deactivator showed that the reaction product of ethylenediamine, 2,5-pentanedione and salicylaldehyde in a 1:1:1 mole ratio was equally as good as the 1,2-disalicylidene propanediamine in preventing or delaying for a substantial period, the formation of copper mercaptide gel.

EXAMPLE 16

The ability of the metal deactivator composition of this invention to suppress the oxidative degradation of fuel oils was tested in 5 types of No. 2 fuel oil, designated as M, S, T, L and A in Table 6. Sample M was a mixture of fuel oils derived from several sources. Sample S was refined from a mixture of 66% Louisiana-Mississippi-sweet (LMS) crude and 34% high-sulfur Texas, 25% Illinois basin, and 12% light Louisiana crudes. Sample L was refined from 100% light Louisiana mixed crude, and sample A came from 100% Arabian sour crude oil. The tests were conducted using the DuPont Petroleum Laboratory Test No. F-2161 test method for measuring color stability and tar formation. This test method is familiar to those skilled in the refining arts.

A sample of each type of fuel oil was tested without any kind or type of additive composition being mixed with it. Other samples of each fuel oil were poisoned by adding to them solubilized copper. Some samples of each were treated by adding copper poison and a measured amount of a mixture of other additives to function as dispersants, antioxidants, rust inhibitors and color stabilizers. Additional samples of each type of fuel oil were poisoned with copper and treated by adding measured amounts of the prior art metal deactivator, N,N'-disalicylidene-1,2-propanediamine and the reaction product obtained in the manner of Examples 1 or 3. The test results are shown in Table 6. In the table the notation "L" indicates "lighter than". A notation "L3.0" thus means lighter than color Number 3 on the scale. An increase in numbers on the scale indicated oxidative degradation as did an increase in the tar rating.

TABLE 6

| Fuel Oil Sample | PPM of Copper Poison | PPM of P/A Metal Deactivator (1) | PPM of Metal Deactivator (2) | PPM of Additive | Color Before | Color After | Tar Rating | Pass or Fail |
|---|---|---|---|---|---|---|---|---|
| — | — | — | — | — | L3.0 | L5.5 | 16 | F |
| " | 4.2 | — | — | — | L3.0 | L5.5 | 16 | F |
| " | 4.2 | — | — | 11.5 | L3.0 | L5.0 | 7 | P |
| " | 4.2 | 2.9 | — | 11.5 | L3.0 | L4.5 | 5 | P |
| " | 4.2 | — | 2.9 | 11.5 | L3.0 | L5.0 | 5 | P |
| " | 4.2 | 5.4 | — | — | L3.0 | L4.0 | 3 | P |
| " | 4.2 | — | 5.4 | — | L3.0 | L4.5 | 3 | P |
| S | — | — | — | — | L1.0 | L8.0 | 12 | F (3) |
| " | — | — | 2.9 | — | L1.0 | L7.0 | 8 | F (3) |
| T | — | — | — | — | L1.0 | L6.0 | 12 | F |
| " | — | 2.9 | — | — | L1.0 | L4.0 | 3 | P |
| " | — | — | 2.9 | — | L1.0 | L3.5 | 3 | P |
| " | 0.8 | — | — | — | L1.0 | L7.5 | 11 | F |
| " | 0.8 | 2.9 | — | — | L1.0 | L5.5 | 6 | P |
| " | 0.8 | — | 2.9 | — | L1.0 | L5.5 | 7 | P |
| L | — | — | — | — | L1.0 | L1.5 | 2 | P |
| " | — | 2.9 | — | — | L1.0 | L1.5 | 2 | P |
| " | — | — | 2.9 | — | L1.0 | L1.5 | 2 | P |
| " | 0.8 | — | — | — | L1.0 | L2.5 | 9 | F |
| " | 0.8 | 2.9 | — | — | L1.0 | L1.5 | 2 | P |
| " | 0.8 | — | 2.9 | — | L1.0 | L2.0 | 2 | P |

TABLE 6-continued

| Fuel Oil Sample | PPM of Copper Poison | PPM of P/A Metal Deactivator (1) | PPM of Metal Deactivator (2) | PPM of Additive | Color Before | Color After | Tar Rating | Pass or Fail |
|---|---|---|---|---|---|---|---|---|
| A | — | — | — | — | L1.0 | L8.0 | 10 | F |
| " | — | 2.9 | — | — | L1.0 | L7.0 | 7 | P |
| " | — | — | 2.9 | — | L1.0 | L6.5 | 6 | P |

(1) Prior art metal deactivator N,N'-disalicylidene-1,2-propanediamine
(2) Product obtained by method of Example 1 or 3
(3) Test run for 180 minutes instead of customary 90 minutes The concentration of metal deactivator made according to the procedure previously described will depend upon the nature of the gasoline, fuel oil, or other hydrocarbon liquid to be treated. Generally a minimum of at least 0.003 ppm of metal deactivator product in the treated hydrocarbon liquid will be necessary. This value does not include the carrier liquid, such as toluene, in which the original reaction may have been conducted, but is based on the weight of reaction products themselves.

I claim:

1. A method for making a metal deactivator composition comprising:

a. partially reacting in a liquid solvent at a temperature below about 200° C., an aliphatic polyamine selected from the the group consisting of ethylenediamine, 1,2-propanediamine, 1,2-diaminocyclohexane, 2,3-diaminobutane, 1,3-propanediamine, 1,3-butanediamine, 2,4-pentanediamine, 1,6-hexanediamine, diethylenetriamine and mixtures of these, with a beta-diketone selected from the group consisting of 2,4-pentanedione, 2,2,6,6-tetramethyl-3,5-heptanedione, 2,6-dimethyl-3,5-heptanedione, 3,5-heptanedione, 2,4-hexanedione, 5-methyl-2,4-hexanedione and 5,5-dimethyl-2,4-hexanedione; and b. reacting the resulting product in a liquid organic solvent completely with salicylaldehyde at a temperature below about 60° C., the mole ratio of said beta-diketone to said aliphatic polyamine of (a) being between about 0.6 to 1 and about 1.4 to 1, the mole ratio of said salicylaldehyde of (b) to said aliphatic polyamine of (a) being between about 1.4 to 1 and about 0.6 to 1, and the ratio of the total moles of said beta-diketone and said salicylaldehyde to the total moles of said ethylenediamine being about 2 to 1.

2. The method of claim 1 wherein said liquid organic solvent of (a) and that of (b) is selected from the group consisting of tetrahydrofuran, toluene, methanol, ethanol, isopropanol, xylene, benzene and diethyl ether.

3. The method of claim 1 wherein said polyamine is ethylenediamine and said beta-diketone is 2,4-pentanedione.

4. The method of claim 1 wherein said polyamine is etylenediamine, said beta-diketone is 2,4-pentanedione, the reaction between said ethylenediamine and said 2,4-pentanedione is conducted at between about 70° C to about 90° C and the reaction with said salicylaldehyde is conducted below about 40° C.

5. The method of claim 4 wherein the mole ratio of 2,4-pentanedione to ethylenediamine is about 1 to 1, the mole ratio of salicylaldehyde is about 1 to 1 and the reactions are conducted in toluene.

6. A method for making metal deactivator compositions comprising reacting a 1,2-polyamine selected from the group consisting of ethylenediamine, 1,2-propanediamine, 1,2-diaminocyclohexane, 2,3-diaminobutane, and mixtures thereof with a 1,3-polyamine selected from the group consisting of 1,3-propanediamine, 1,3-butanediamine, 2,4-pentanediamine and mixtures thereof, and subsequently reacting a beta-diketone selected from the group consisting of 2,4-pentanedione, 2,2,6,6-tetramethyl-3,5-heptanedione, 2,6-dimethyl-3,5-heptanedione, 2,4-hexanedione, 5-methyl-2,4-hexanedione and 5,5-dimethyl-2,4-hexanedione, said method further comprising;

a. reacting the 1,2-polyamine with the beta-diketone in a mole ratio of said 1,2-polyamine to said diketone of about 1 to 1 at a temperature below 200° C.

b. adding the 1,3-polyamine to the reaction mixture thus obtained;

c. reacting substantially to completion the 1,3-polyamine and unreacted 1,2-polyamine at a temperature below 60° C. with an ortho-hydroxybenzaldehyde having the structural formula:

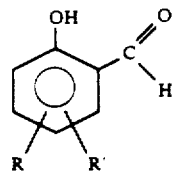

where R and R' are hydrogen, or aliphatic hydrocarbons having a total of 0 to 12 carbon atoms; and d. recovering the liquid organic mixture resulting.

7. The method of claim 6 wherein said reactions are conducted in an organic solvent.

8. The method of claim 6 wherein said reactions are conducted in an organic liquid solvent selected from the group consisting of tetrahydrofuran, toluene, methanol, ethanol, isopropanol, xylene, benzene and diethyl ether

9. The method of claim 6 wherein the reaction step between said 1,2-polyamine and said beta-diketone is conducted in a batch reaction at a maximum temperature of 200° C. and the reaction step between the resulting intermediate product, said 1,3-polyamine and said ortho-hydroxybenzaldehyde is conducted at a maximum temperature of 60° C.

10. The method of claim 6 wherein all of the reactions are conducted continually at a temperature not in excess of 200° C.

11. The method of claim 6 wherein the mole ratio of beta-diketone to 1,2-polyamine is between about 1.4 to 1 and about 0.6 to 1, the number of moles or ortho-hydroxybenzaldehyde reacted is equal to the sum of twice the number of moles of 1,2-polyamines and twice the number of moles of 1,3-polyamines reacted less the number of moles of beta-diketone reacted, the ratio of the total moles of beta-diketone and ortho-hydroxybenzaldehyde reacted to the total moles of 1,2- and 1,3-polyamines is about 2 to 1, and the mole ratio of 1,3-polyamines to 1,2-polyamines is between about 5 to 1 and about 0 to 1.

12. The method of claim 6 wherein;

a. the 1,2-polyamine is ethylenediamine, b. the 1,3-polyamine is 1,3-propanediamine, c. the beta-diketone is 2,4-pentanedione, d. the ortho-hydroxybenzaldehyde is salicylaldehyde, e. the ethylenediamine and 2,4-pentanedione are reacted at a temperature between about 70° C. and 90° C., and f. the resulting reaction product is reacted with the 1,3-propanediamine and salicylaldehyde at a temperature below about 40° C.

* * * * *